US009391395B2

(12) United States Patent
Bieletzki-Welz et al.

(10) Patent No.: US 9,391,395 B2
(45) Date of Patent: Jul. 12, 2016

(54) CONNECTOR ASSEMBLY

(75) Inventors: Viktor Bieletzki-Welz, Leichlingen (DE); Shenol Hasan, Sofia (BG); Plamen Baldzhiyski, Botevgrad (BG); Laurent Montarou, Asnieres sur Seine (FR)

(73) Assignee: Johnson Controls Technology Company, Holland, MI (US)

( * ) Notice: Subject to any disclaimer, the term of this patent is extended or adjusted under 35 U.S.C. 154(b) by 282 days.

(21) Appl. No.: 13/876,566

(22) PCT Filed: Sep. 30, 2011

(86) PCT No.: PCT/EP2011/067146

§ 371 (c)(1),
(2), (4) Date: Jun. 13, 2013

(87) PCT Pub. No.: WO2012/042032

PCT Pub. Date: Apr. 5, 2012

(65) Prior Publication Data

US 2013/0252452 A1 Sep. 26, 2013

(30) Foreign Application Priority Data

Oct. 1, 2010 (DE) ..... 10 2010 047 282
Dec. 17, 2010 (EP) ..... 10195719

(51) Int. Cl.
*H01R 13/64* (2006.01)
*H01R 13/627* (2006.01)
*H01R 12/58* (2011.01)
(Continued)

(52) U.S. Cl.
CPC ..... *H01R 13/6271* (2013.01); *H01R 12/58* (2013.01); *H01R 13/6315* (2013.01); *H01R 13/502* (2013.01); *H01R 13/741* (2013.01)

(58) Field of Classification Search
CPC . H01R 13/6315; H01R 13/6271; H01R 12/58
USPC ..... 439/350, 351, 660, 634, 626, 599, 686, 439/248, 247
See application file for complete search history.

(56) References Cited

U.S. PATENT DOCUMENTS 5,004,430 A 4/1991 DelGuidice et al.
6,147,875 A * 11/2000 Yoshigi ..... 439/247
2010/0144196 A1 6/2010 Liu et al.

FOREIGN PATENT DOCUMENTS

CN 201303146 Y 9/2009
CN 201365017 Y 12/2009
(Continued)

OTHER PUBLICATIONS

Office Action dated Aug. 5, 2014 in corresponding Japanese Application No. 2013-529680, 4 pages.
(Continued)

*Primary Examiner* — Felix O Figueroa
(74) *Attorney, Agent, or Firm* — Foley & Lardner LLP

(57) ABSTRACT

A connector assembly includes a connector affixed to a printed circuit board and a covering with an integrated holding frame slidably mounted onto the connector. The covering has an opening in which the holding frame is integrated as an inner frame with a compensation gap to the surface of the opening. The covering includes a flexible connection between the surface of the opening and the holding frame to align the holding frame within the opening during insertion of the covering onto the connector.

8 Claims, 3 Drawing Sheets

(51) Int. Cl.

| | |
|---|---|
| ***H01R 13/631*** | (2006.01) |
| *H01R 13/502* | (2006.01) |
| *H01R 13/74* | (2006.01) |

(56) References Cited

FOREIGN PATENT DOCUMENTS

| | | | |
|---|---|---|---|
| DE | 1020060 37 060 | B3 | 2/2008 |
| EP | 0 797 273 | A2 | 9/1997 |
| JP | 2002-042961 | | 2/2002 |
| JP | 2002-056938 | A | 2/2002 |

OTHER PUBLICATIONS

Office Action dated Nov. 15, 2014, in corresponding Chinese application No. 201180047698.7 and English translation, 14 pages.

Office Action dated Sep. 24, 2014, in corresponding Korean Patent Application No. 10-2013-7011-245 and English translation, 10 pages.

Office Action dated Apr. 1, 2014 issued in corresponding Japanese Application No. 2013-529680.

International Search Report received in connection with international application No. PCT/EP2011/067146; dtd Dec. 27, 2011.

* cited by examiner

CONNECTOR ASSEMBLY

CROSS REFERENCE TO RELATED APPLICATIONS

The present application is a National Stage of International Application No. PCT/EP2011/067146 filed on Sep. 30, 2011, which claims the benefit of German Patent Application No. 10 2010 047 282.4 filed on Oct. 1, 2010, and European Patent Application No. 10195719.9 filed Dec. 17, 2010, the entire disclosures of which are incorporated herein by reference.

TECHNICAL FIELD

The present invention relates to a connector assembly for a printed circuit board.

BACKGROUND OF THE INVENTION

Various types of electrical connectors for printed circuit boards are well known. Generally, they are designed as pins which are connected to each other by means of a support base or block to enable an automated assembly on the printed circuit board.

In addition, the pins are generally surrounded by a frame-like holding to protect the pins from damage. Such a connector assembly formed by a support and a pin connector positioned therein requires a complex and very precise alignment of all parts during assembly in order to avoid damaging the pins.

SUMMARY OF THE INVENTION

It is an object of the present invention to provide an improved connector assembly with regards to the assembly.

According to the invention, the object is achieved by a connector assembly according to claim 1.

Preferred embodiments of the invention are given in the dependent claims.

A connector assembly comprises a connector which is affixed to a printed circuit board and a covering with an integrated holding frame slidably mounted onto the connector. Thereby, the covering has an opening in which the holding frame is integrated as an inner frame with a compensation gap to the surface of the opening. Furthermore, the covering comprises a flexible connection between the surface of the opening and the holding frame to align the holding frame within the opening during insertion of the covering onto the connector.

Such a relatively free movable placement of the holding frame within the opening allows an easier alignment and centering of the holding frame on the connector and to the printed circuit board. Thus, the placement and assembly of the holding frame onto the connector is improved during insertion of the covering onto the connector.

The connector is conventionally mounted on a printed circuit board with pins, for example, material-forced, in particular soldered. Thereby, only the holding frame needs to be aligned relative to the connector. The size and shape of the holding frame is designed such that it is freely movable in the opening of the covering in a longitudinal and/or lateral orientation.

For centering the connector, e.g. the pin-block, onto the printed circuit board the connector comprises bolts, screws or other means fixable in bores of the printed circuit board.

In addition, when connecting the connector assembly of the printed circuit board, for example, with an extension board or a corresponding connector assembly, in particular with pin corresponding sockets, only the holding frame is aligned in the opening to the corresponding connector assembly. The conventional complex alignment of the individual rows and columns of the pins of the connector on the individual rows and columns of a corresponding socket of the corresponding connector assembly is avoided, so that the assembly is simplified and reduced in time.

In an embodiment of the connector assembly at least one pair of fasteners is provided on opposite sides of the holding frame for fixing the holding frame to the connector. Thus, the covering with the holding frame can easily be assembled and fixed onto the connector. The fastener is formed as a threaded connection, a hot stamping connection, a clip connection, a snap-on connection or threaded connection.

Preferably, each fastener comprises an alignment snap-fit on one side of the holding frame and the connector and a complimentary engaging member on the other side of the holding frame and the connector.

As an additional simple assembling of the covering onto the connector guiding slots are engageable between a pin-socket of the connector and the holding frame. The guiding slots allow the holding frame to be easily moved during assembling.

In a further embodiment, at least one pair of flexible connections on opposite sides of the opening is provided to movably fix the holding frame into the opening. Such a flexible connection allows a clearance of the holding frame in the covering so that the covering with the integrated freely movable holding frame can easily be assembled onto the connector.

In an embodiment the flexible connection comprises resilient arms formed in a cut-out of the opening between the surface of the opening and the holding frame. For instance, the resilient arms are curved. Such curved, especially S-curved resilient arms allow easy alignment and centering of the holding frame within the opening and thus an improved assembly during insertion of the covering onto the connector.

It is an additional feature of the invention to reduce the number of parts of the connector assembly. The connector assembly is constructed in such a manner that the covering, the flexible connection and the holding frame are designed as one formed part, especially one moulded part. Such one moulded part is less expensive and easier in manufacturing, e.g. by injection moulding.

For a further simple construction of the connector assembly the connector is a multi-pin connector which comprises at least a pin-socket with a plurality of spaced pins (shortly named pin-block).

Details of the present invention are described hereinafter. However, it should be understood that the detailed description and the specific examples indicate possible embodiments of the invention and are given by way of illustration only. Various changes and modifications of the illustrated embodiments within the spirit and scope of the invention are appreciated by those skilled in the art.

BRIEF DESCRIPTION OF THE DRAWINGS

The present invention will be better understood from the detailed description given in the following. The accompanying drawings are given for illustrative purposes only and do not limit the scope of the present invention.

DETAILED DESCRIPTION OF THE PREFERRED EMBODIMENTS

Figure 1:
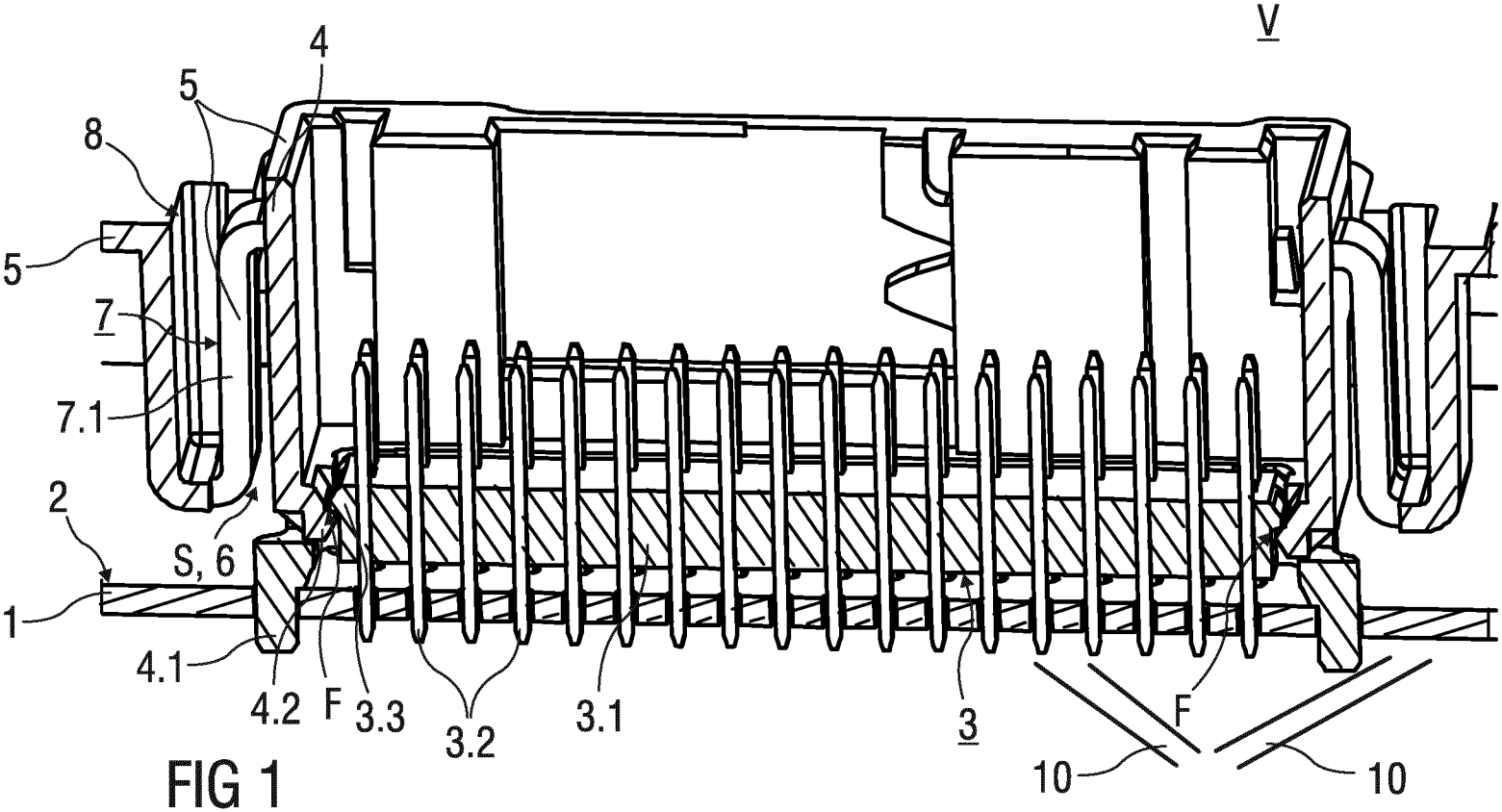
FIG. 1 is schematically a perspective view of a connector assembly arranged on a surface of a printed circuit board with a connector inserted in a holding frame, wherein the holding frame is capable of free movement in a covering.

FIG. 1 shows a perspective view of a printed circuit board 1, which is provided with a connector 3 on a surface 2.

The connector 3 is designed as a pin-socket 3.1 with pins 3.2 that are arranged in rows and columns. For example, the connector 3 is formed as a 10-, 24-, 51- or 81-pin connector or other type of connectors. The pins 3.2 of the connector 3 extend over the flat surface of the printed circuit board 1.

The pins 3.2 are designed as electrically conductive metallic pins which are fixed in form holes of the printed circuit board 1 as to be force-locked and/or form-locked and/or material-locked. The pin-socket 3.1, for example a base or a block with passages for receiving the pins 3.2 can be formed of an electrically non-conductive material, particularly a plastic.

Additionally, the connector 3 is affixed to the printed circuit board 1 by means of bolts 4.1 in a conventional manner.

On the connector 3, a holding frame 4 is attachable. The connector 3 and the holding frame 4 are connected releasably to each other by at least one pair of fasteners F on opposite sides of the holding frame 4.

The fastener F is formed as a threaded connection, a hot stamping connection, a clip connection, a snap connection or threaded connection.

For each fastener F, the pin-socket 3.1 has an engagement member 3.3, which is designed as a circumferential ridge and arranged opposite to the printed circuit board 1. Alignment snap-fits 4.2 formed on the holding frame 4 engage in the engaging member 3.3 in a form-closed and/or force-closed way.

The holding frame 4 can be formed as a solid and in particular electrically and/or thermally conductive frame. The holding frame 4 can be made of a metallic material, for example, aluminum pressure casting.

The holding frame 4 can be additionally affixed to the printed circuit board 1 by fitting means, e.g. by not shown bolts, like the bolts 4.1 of the connector 3 in a conventional manner. Alternatively, the holding frame 4 can be affixed by screws, rivets or other means.

The holding frame 4 has such dimensions, in particular a height of the side walls, that in the assembled state of connector 3 and holding frame 4 the pins 3.2 are laterally surrounded by the holding frame 4 on the side of the printed circuit board 1, or that the holding frame 4 overtops the pins 3.2, so that the pins 3.2 are protected from damage, for example during falling down or beating or other mechanical stresses.

To the surface 2 of the printed circuit board 1 the connector assembly V is side closed by a covering 5, which can be mechanically coupled to the printed circuit board 1 in a not shown way.

The holding frame 4 is integrated in the covering 5, so that the holding frame 4 together with the covering 5 is slidably mounted onto the connector 3. For this, the covering 5 has an opening 6 in which the holding frame 4 is integrated as an inner frame.

Alternatively, the holding frame 4 is designed as an individual component, which is mechanically coupled to the covering 5.

Furthermore, the covering 5 comprises flexible connections 7 respectively fitted centrically in the direction of two opposed outer lateral walls of the holding frame 4.

These flexible connections 7, in particular a number of flexible connections 7, which are arranged on each side of the holding frame 4, are performed by curved resilient arms 7.1, which freely protrude and bent from the covering 5 in a corresponding cut-out 8 of the covering 5, thereby the resilient arms 7.1 run along the longitudinal axis of the connector 3 parallel to it. The resilient ends of the flexible connections 7 are fitted on the open end of the holding frame 4, which is arranged opposite to the printed circuit board 1.

The opening 6 in the covering 5 is chosen in such a way, that a compensation gap S is formed between the holding frame 4 and the covering 5. Alternatively, the size and shape of the holding frame 4 may be designed such that it is freely movable in the opening 6 of the covering 6 in a longitudinal or lateral orientation under forming the compensation gap S. This allows easy alignment and centering of the holding frame 4 within the opening 6 and thus an improved assembly during insertion of the covering 5 onto the connector 3.

For an essential free of play and central fitting of the holding frame 4 on the connector 3, in particular on the pin-socket 3.1, the pin-socket 3.1 has guiding slots 9 or recesses.

In a preferred embodiment, only the holding frame 4 is needed to be aligned in the opening 6 in the compensation gap S during connection of the connector assembly V of the printed circuit board 1 with, for example a not shown extending plate or a not shown corresponding connector assembly.

Thus, the conventional complex alignment of the individual rows and columns of the pins 3.2 of the connector 3 on the individual rows and columns of a corresponding socket of the corresponding connector assembly V is avoided, so that the assembly is simplified and reduced in time.

Furthermore, such a connector assembly V allows an assembly of it during the soldering process, as solder- and pin-side are the same.

In addition, FIG. 1 shows a beam 10 for support of the circuit board 1. The beam 10 is designed as a net-like support structure or a support plate.

Figure 2:
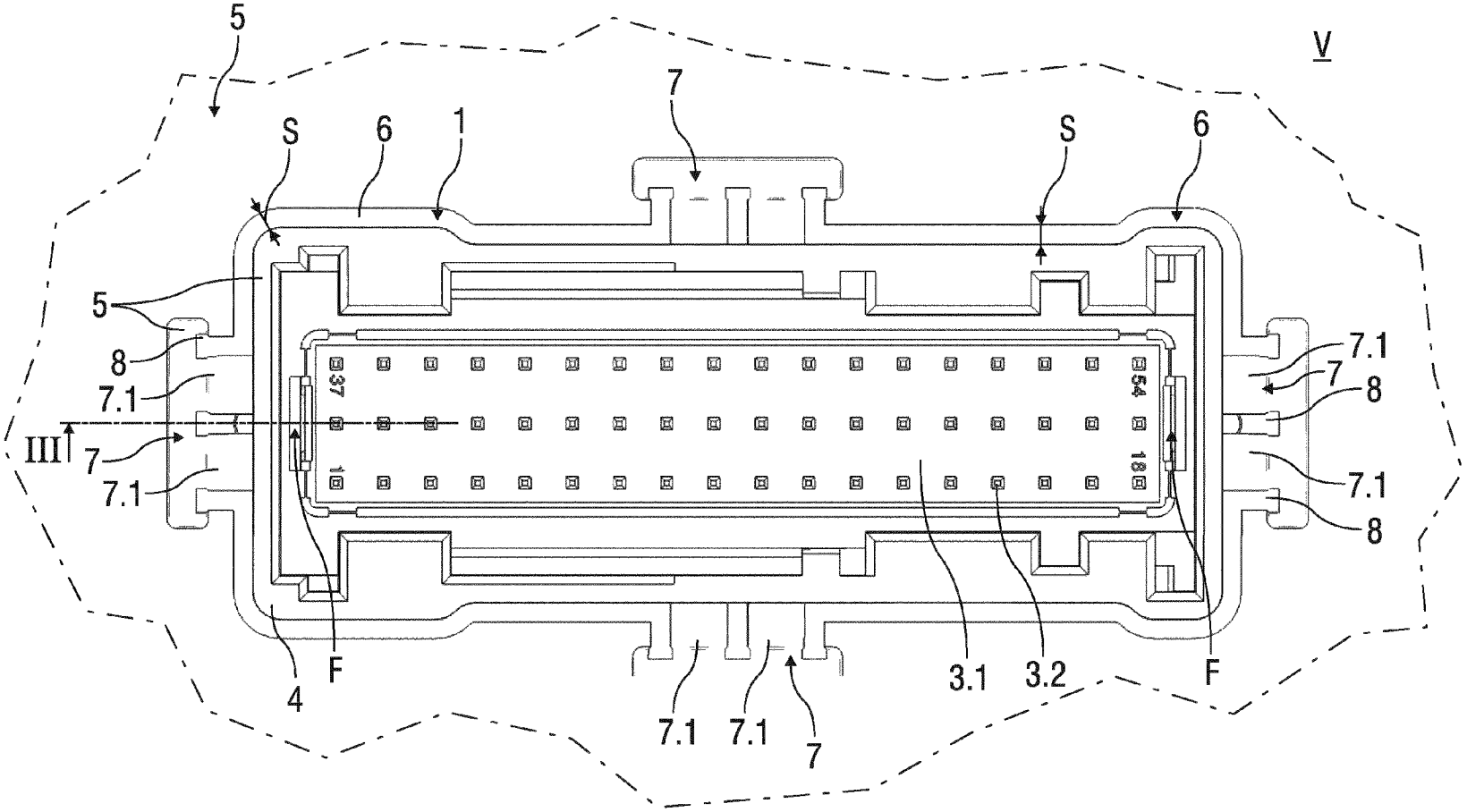
FIG. 2 is schematically a top view of the covering with the connector assembly arranged on the printed circuit board.

FIG. 2 shows schematically a top view of the covering 5 with the connector assembly V on the printed circuit board 1.

Figure 3:
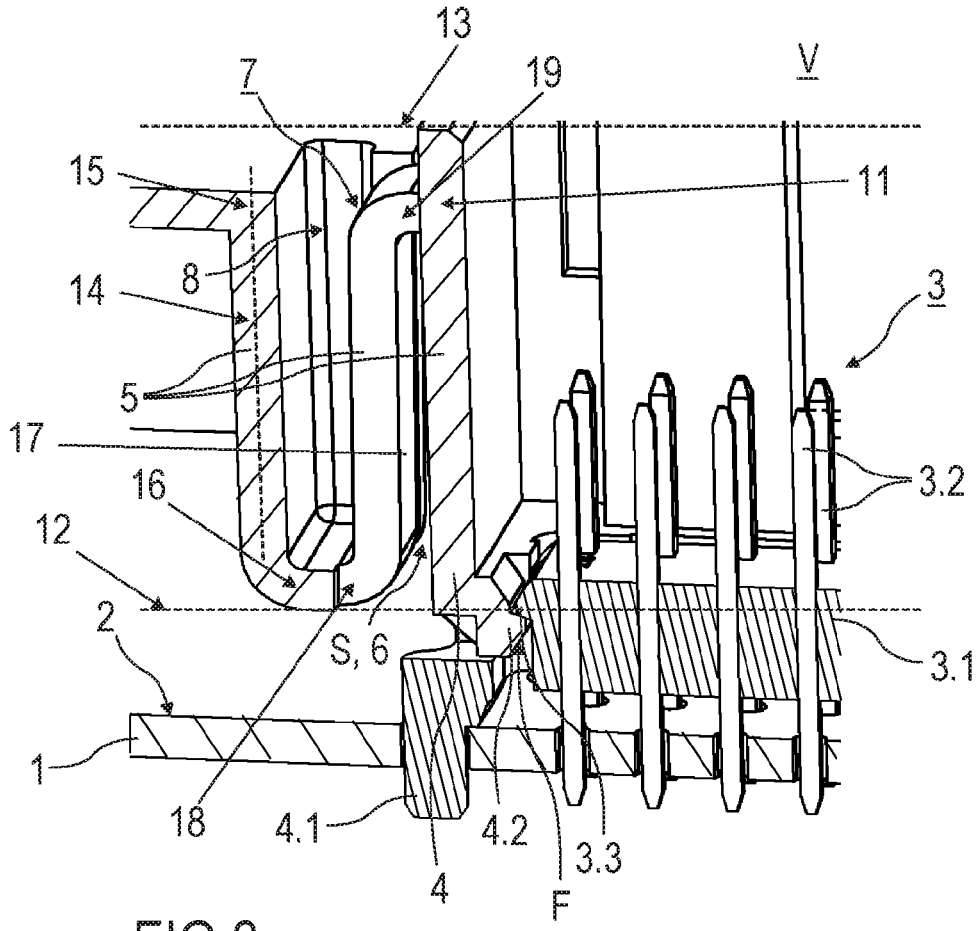
FIG. 3 is schematically a perspective view of an enlarged section of the connector assembly.

FIG. 3 shows schematically an enlarged section of the connector assembly V according to FIG. 2.

In one embodiment, the holding frame 4 includes a sidewall 11 extending from a first plane 12 parallel to and proximate to the printed circuit board 1 when the holding frame 4 is mounted onto the connector 3 and a second plane 13 parallel to the first plane 12 and distal from the printed circuit board 1. The opening 6 extends along a third plane 14 parallel to the sidewall 11 from an origin 15 proximate to the second plane 13 towards a terminal 16 proximate to the first plane 12. The origin 15 and the terminal 16 are each located between the first plane 12 and the second plane 13. The resilient arm 7.1 includes an arm surface 17 facing the sidewall 11. The arm surface 17 is defined between a first end 18 and a second end 19 opposite the first end 18.

LIST OF REFERENCES

1 Printed circuit board
2 Surface
3 Connector
3.1 Pin-socket
3.2 Pin
3.2 Engaging member
4 Holding Frame

4.1 Bolt
4.2 Snap-fit
5 Covering
6 Opening
7 Flexible connection
7.1 Resilient arm
8 Cut-out
9 Guiding slot
10 Beam
11 Sidewall
12 First plane
13 Second plane
14 Third plane
15 Origin
16 Terminal
17 Arm surface
18 First end
19 Second end
F Fastener
S Compensation gap
V Connector assembly

The invention claimed is:

1. A connector assembly comprising:

a connector affixed to a printed circuit board; and a covering with an integrated holding frame slidably mounted onto the connector, wherein the covering has an opening in which the holding frame is integrated as an inner frame with a compensation gap to the surface of the opening, the covering comprises two flexible connections disposed between the surface of the opening and the holding frame to align the holding frame within the opening during insertion of the covering onto the connector, wherein a first flexible connection is disposed on an opposite side of the holding frame from a second flexible connection;

wherein the holding frame includes a sidewall extending from a first plane parallel to and proximate to the printed circuit board when the holding frame is mounted onto the connector and a second plane parallel to the first plane and distal from the printed circuit board, wherein the opening extends along a third plane parallel to the sidewall from an origin proximate to the second plane towards a terminal proximate to the first plane, wherein the origin and the terminal are each located between the first plane and the second plane, wherein each flexible connection comprises a resilient arm formed in a cut-out of the opening between a surface of the opening and the holding frame, wherein the resilient arm includes an arm surface facing the sidewall, the arm surface defined between a first end and a second end opposite the first end, wherein the second end is offset from the first end along a direction in which pins of the connector extend, wherein the first end is integral with the terminal, wherein at least a portion of the compensation gap is defined between the sidewall and the arm surface, wherein at least one pair of fasteners on opposite sides of the holding frame is provided for fixing the holding frame to the connector, and wherein the covering, each flexible connection, and the holding frame are provided as one formed part.

2. A connector assembly according to claim 1, wherein the fastener is formed as a threaded connection, a hot stamping connection, a clip connection, a snap-on connection or threaded connection.

3. A connector assembly according to claim 1, wherein each fastener comprises an alignment snap-fit on one side of the holding frame and the connector and a complimentary engaging member on the other side of the holding frame and the connector.

4. A connector assembly according to claim 1, wherein guiding slots are engageable between a pin-socket of the connector and the holding frame.

5. A connector assembly according to claim 1, wherein at least one pair of flexible connections on opposite sides of the opening is provided to movably fix the holding frame into the opening.

6. A connector assembly according to claim 1, wherein the covering, the flexible connection and the holding frame are designed as one moulded part.

7. A connector assembly according to claim 1, wherein the connector is a multi-pin connector which comprises at least a pin-socket with a plurality of spaced pins.

8. A connector assembly according to claim 1, wherein each resilient arm of the flexible connections freely protrudes and bends from the covering in the cut-out of the covering.

* * * * *